United States Patent [19]

Lott

[11] Patent Number: 5,071,136

[45] Date of Patent: Dec. 10, 1991

[54] COLLECTABLE SPORTS CARD BOARD GAME

[76] Inventor: Nathaniel E. Lott, 20 Hales Ct., Westport, Conn. 06880

[21] Appl. No.: 610,703

[22] Filed: Nov. 8, 1990

[51] Int. Cl.[5] ..... A63F 3/00

[52] U.S. Cl. ..... 273/259; 273/298

[58] Field of Search ..... 273/93 C, 244, 259, 273/268, 298

[56] References Cited

U.S. PATENT DOCUMENTS

| | | | |
|---|---|---|---|
| 378,497 | 2/1888 | Couch | 273/93 C |
| 957,872 | 5/1910 | Ely | 273/93 C |
| 1,153,899 | 9/1915 | Elcouin | 273/244 X |
| 1,522,859 | 2/1925 | Blume | 273/298 |
| 2,788,213 | 4/1957 | Hull | 273/298 X |
| 4,486,022 | 12/1984 | Dixon | 273/244 X |
| 4,815,745 | 3/1989 | Alvarez, Jr. | 273/259 |

FOREIGN PATENT DOCUMENTS

| | | | |
|---|---|---|---|
| 2409778 | 7/1979 | France | 273/244 |
| 2154148 | 9/1985 | United Kingdom | 273/268 |

*Primary Examiner*—Edward M. Coven
*Assistant Examiner*—William E. Stoll

[57] ABSTRACT

A collectable sports card board game comprising a game board divided into a plurality of hoizontally and vertically disposed rows of rectangles constituting a matrix. Indicia along the top of the vertical rows and down the side of the horizontal rows describe the coordinates by which each rectangle within the matrix can be identified. Denoted within each rectangle in the matrix there is a monetary value. A sports figure collectable card, held within a clear plastic sleeve with player positions and rating numbers denoted on the reverse side, is placed within each of the rectangles of the matrix. Two dice, one of which is a different color than the other, are used to determine the coordinates for randomly selecting one of the rectangles. Each player rolls the dice and is awarded the sports figure card indicated by the resulting coordinates. The first player to put together a team is awarded points. The second player to put together a team is also awarded points, but fewer points than the first player. When all players have constructed the best team they can, either by means of the dice toss or by buying sports figure cards from other players, the team score is determined by totaling the position rating for each card in the team. Points are awarded for each players team total and for cash on hand at the end of the game. The player with the highest point value is declared the winner.

4 Claims, 1 Drawing Sheet

| | 1 | 2 | 3 | 4 | 5 | 6 |
|---|---|---|---|---|---|---|
| 1 | $1.00 | $2.00 | $3.00 | $4.00 | $5.00 | $6.00 |
| 2 | $6.00 | $5.00 | $4.00 | $3.00 | $2.00 | $1.00 |
| 3 | $3.00 | $4.00 | $5.00 | $6.00 | $1.00 | $2.00 |
| 4 | $5.00 | $6.00 | $1.00 | $2.00 | $3.00 | $4.00 |
| 5 | $4.00 | $3.00 | $2.00 | $1.00 | $6.00 | $5.00 |
| 6 | $2.00 | $1.00 | $6.00 | $5.00 | $4.00 | $3.00 |
13 10 15 12 14 11
FIG. 1
FIG. 4
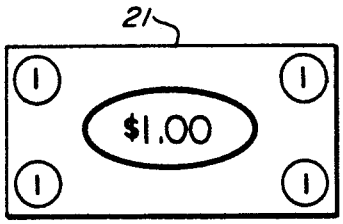
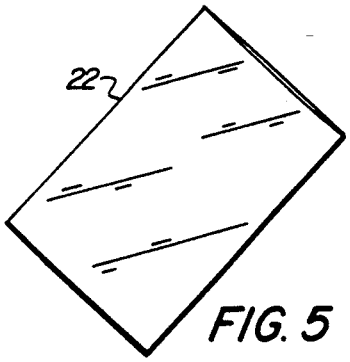
FIG. 5
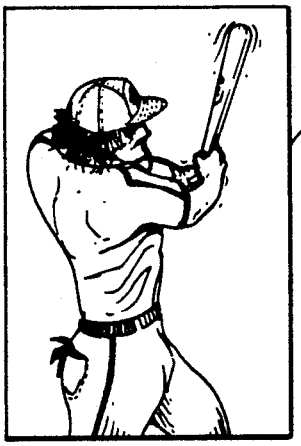
FIG. 2
18
INFIELDER
| POS. | RATING |
|---|---|
| 3 | 6 |
| 2 | 8 |
| 1 | 7 |
| S.S. | 5 |
19 17 20
FIG. 3
FIG. 6
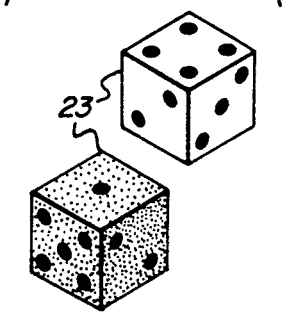

COLLECTABLE SPORTS CARD BOARD GAME

SUMMARY OF THE INVENTION

The object of this invention is to provide a new board game utilizing collectable sports figure cards, whereby collectors of these cards can use their own collection to build their favorite teams or use the cards provided with the game, whereby players of the game toss dice to randomly select a number of these cards , a furhter object of the game being for each player to construct a team from these randomly selected cards. Points are awarded for first and second team , for highest team rating and for cash on hand at the end of the game. To this end the present invention comprises a game board the surface of which is divided so as to provide a plurality of horizontally and vertically arranged rows of rectangles. Each rectangle being identified by coordinate numbers of one color, along the top of each vertical row and coordinate numbers of a different color, down one side at the end of each horizontal row. Within each rectangle is denoted a randomly distributed monetary value. As accessory pieces to the game board, there is provided a deck of sports figure cards,one for each of the rectangles depicted on the board, each card denoting thereon one or more sports playing positions and an accompanying rating number for each position. As further accessories to the game board, there is provided a pair of dice, one of which is a different color than the other, simulated currency to be used in transactions between players involving the buying and selling of sports figure cards, and a plurality of clear plastic sleeves, all of which will be more fully discussed hereinafter.

DESCRIPTION OF DRAWINGS

FIG. 1 is a plan view of the game board of this invention.

FIG. 2 is a plan view of a typical sports figure collectable card.

FIG. 3 is a plan view of the reverse side of sports figure card depicting a typical multi player position rating.

FIG. 4 is a plan view of simulated currency.

FIG. 5 is a plan view of a clear plastic sleeve.

FIG. 6 is an isometric view of a pair of dice.

DESCRIPTION OF THE PREFERRED EMBODIMENT

Referring to FIG. 1 of the drawing, reference numeral 10 denotes the game board of this invention the surface of which is divided into a plurality of horizontally and vertically disposed rows of rectangles indicated horizontally as 11, and vertically as 12. The total number of rectangles depicted on the surface of the game board 10 may vary according to the number of dice employed but for purposes of describing this embodiment of the invention they constitute 36 in number as shown in FIG.1 Each vertical row of rectangles is identified by a number indicated at the top of each row, reference as 13. Similarly, each horizontal row is identified by a number indicated along the left side of board 10, referenced as 14. The vertical numbers, 13, range from one to six and are identical to the horizontal numbers, 14, except that each set of numbers is of a different color. Within each rectangle depicted on board 10, there is indicia representing a monetary value, referened as 15. For purposes of this description, these values, 15, range from $1.00 to $6.00.

Referring to FIG. 2 , reference numeral 16 denotes a collectable sports figure card. For purposes of describing this embodiment of the invention the sports figures depicted on card 16 represent baseball players . The cards therefore will depict baseball players in various playing positions, fielding, batting, pitching or catching. There are thirty six of these cards provided with this embodiment of the gaqme, one for each of the rectangles depicted on game board 10. However, baseball card collectors may substitute their own cards making up a game of their own favorite players.

Referring to FIG. 3, reference numeral 17 denotes the reverse side of a, multi position, collectable sports figure card, denoting thereon the name of the position, infielder, reference numeral 18, the position played, third base, second base, first base and short stop, reference numeral 19, and the individual player rating for each of these posititions, reference numeral 20. In this embodiment of the invention there will be four cards rating pitchers, four cards rating catchers, twelve cards rating outfielder who may substitue for first basemen with a different rating for that position, and sixteen infielders with individual ratings for each infield position.

Referring to FIG. 4 reference numeral 21 depicts typical simulated currency of the type that will be used by players to conduct transactions involving the buying and selling, between players, of the various collectable sports figure cards. This currency will also be used to compensate players when game board 10 rectangles, 11 and 12, no longer hold sports figure cards, 16. The currency denominations may vary of course, but, for this embodiment of the game they will consist of one, two , five and ten dollar bills.

Referring to FIG. 5 reference numeral 22 depicts a clear plastic sleeve designed to hold a collectable sports figure card, 16. When collectors choose to use their own cards, subsitute cards will be placed in sleeve 22 along with card 16 so that only the rating side of card 16, reference numeral 17, is visable.

Referring to FIG. 6 reference numeral 23 depicts a pair of dice, one die a different color than the other. In intiating the game of this invention, the thirty six collectable sports figure cards, 16, are placed in individual sleeves, 22. The cards are then shuffled and placed, rating side down, one each in the rectangles, 11–12, of game board 10. Each player is given an initial sum of simulated currency, 21. Again, the amout may vary, but, for purposes of this discription the sum will be ten dollars. One player is selected as banker and will retain the rest of the currency. Order of play is determined by rolling the dice high score first. etc.This order will be maintained throughout the game. Players, in turn, will roll the dice and take possesion of the card occupying the rectangle identifed by the rectangular coordinates indicated by a reading of the dice,one color across the top, the other color down the side. Play will continue in this fashion until one player has filled all nine player postions on a regulation baseball team, one pitcher, one catcher, four infielders and three outfielders. This player is then awarded ten dollars by the bank for being the first player to come up with a team. The second player to come up with a team will be awarded five dollars. Play continues with all players participating until all remaining players have built full teams, or until one of the players with a team calls for a challenge. This can only be done when at least two players, hold full teams . At this point, board play ends but all players have the opportunity to buy, sell or trade cards in an effort to come up with the nine cards that will give them the highest score. Cards used to fill positions other than those designated, have a scoring value of only one point. When players roll the dice and the rectangle that comes up no longer holds a sports figure card, that player is awarded the dollar value indicated in the rectangle. When no player has called for a challenge and all collectable sports figure cards have been selected from the board , all players must cooperate in bulding each others teams. At this point excess player cards are auctioned or, at minimum, sold for face value equal to the highest rating value of any position indicated on the card. When all players have built a team, total team value will be calculated by adding the rating value for each of the nine postions to which cards have been assigned. This total for each player is then added to the total money each player has in pocession , one point for each dollar, and the player with the most points is declared the winner.

What is claimed is:

1. A collectable sports card board game for two or more players comprising: (a) a game board the surface of which has delineated thereon the outline of a rectangle whose area is subdivided into a plurality of rectangles constituting horizontally and vertically disposed rows of rectangles, each vertical row headed by a different indicia, said indicia being all of the same color, each horizontal row being headed by a different indicia, each indicia of said horizontal row being all of the sam, [1] color but of a different color than the indicia of the vertical rows, each of said plurality of rectangles bearing indicia representing randomly disposed monetary values; (b) a deck of sports figure cards, each card having delineated thereon a representation of a sports player engaged in the playing of a particular playing position, the reverse side of each of said cards bearing the name of one or more player positions and a player rating number for each of said positions; (c) two dice each die being of a side of each of said cards bearing the name of one or more player positions and a player rating number for each of said positions; (c) two dice each die being of a color representing heading indicia of vertically disposed rows of rectangles or heading indicia of horizontally disposed rows of rectangles delineated on said game board , there being one of each of said colored die in each set of dice; (d) a plurality of simulated currency of various denominations suitable for player buying and selling transactions; and (e) a plurality of clear plastic sleeves, one each for each of the sports figure cards of said deck of sports figure cards.

2. The board game of claim 1 wherein said vertically disposed row heading indicia of rectangles of said game board corresponds to one each of the indicia represented on a correspondingly colored die, and the horizontally disposed row heading indicia corresponds to one each of the indicia of a correspondingly colored die, making it possible that on any random toss of said set of dice, the different colored dice indicia will represent the coordinates of one of the rectangles delineated on said game board.

3. The board game of claim 1 wherein rating numbers delineated on the reverse side of those said sports figure cards bearing multiple player positions, have a different rating for each position so delineated thereon, the object being for game players to arrive at the highest possible team rating by shifting said cards from one player position to another as the opportunity to do so presents itself during the course of the game.

4. The board game of claim 1 wherein the said clear plastic sleeves are designed large enough to hold one of the said sports figure cards and any additional sports figure card as a player might select from his or her own collection.

* * * * *